United States Patent [19]

Daugherty et al.

[11] 4,415,780

[45] Nov. 15, 1983

[54] KEYBOARD WITH EDGE VENT

[75] Inventors: James B. Daugherty; Frederick A. Balash, both of Mesa, Ariz.

[73] Assignee: Rogers Corporation, Rogers, Conn.

[21] Appl. No.: 267,787

[22] Filed: May 28, 1981

[51] Int. Cl.[3] ..... H01H 13/70

[52] U.S. Cl. ..... 200/5 A; 200/159 B; 200/306

[58] Field of Search ..... 200/5 R, 5 A, 159 B, 200/86 R, 306

[56] References Cited

U.S. PATENT DOCUMENTS

| | | | |
|---|---|---|---|
| 4,046,975 | 9/1977 | Seeger, Jr. | 200/5 A |
| 4,066,851 | 1/1978 | White et al. | 200/5 A |
| 4,249,044 | 2/1981 | Larson | 200/159 B X |
| 4,300,029 | 11/1981 | Maser | 200/159 B |
| 4,365,130 | 12/1982 | Christensen | 200/5 A X |

*Primary Examiner*—J. R. Scott

*Attorney, Agent, or Firm*—David S. Fishman

[57] ABSTRACT

An electrical switch assembly of the type comprising a pair of printed circuits separated by an apertured spacer wherein passages are provided to vent gas from the region of each individual switch and the edge of the assembly.

10 Claims, 10 Drawing Figures

KEYBOARD WITH EDGE VENT

BACKGROUND OF THE INVENTION (1) Field of the Invention

The present invention relates to an improved membrane switch assembly. Specifically, the present invention relates to a membrane switch assembly having internal cavities that are edge vented to the external environment and methods of manufacture thereof.

(2) Description of the Prior Art

Prior art membrane switch assemblies are usually constructed by laminating a spacer sheet between two substrates which support "printed" circuits. The substrate bearing the printed circuits are positioned so that circuit patterns thereon face each other. The switches are defined by providing the spacer sheet with apertures so that, with the application of pressure, the circuits can be made to contact each other. These prior art membrane switch assemblies were usually constructed so that the apertures within the spacer sheet formed cavities that were permanently sealed from the surrounding environment. These cavities were usually filled with a fluid, primarily air.

The above-described prior art method of constructing membrane switch assemblies has certain disadvantages. A major disadvantage which results from permanently sealing the cavities defined by the spacer sheet apetures occurs when there is a change in the external fluid pressure, the atmospheric pressure for example. If a machine which incorporates the membrane switch assembly is located at an altitude where the outside atmospheric pressure is less than the pressure in the sealed cavities, the greater internal pressure exerts an outward force upon the layers of the switch laminate. The result of this outward expansion is that there is a cushioning effect to the operation of the individual keys. With a sufficiently large pressure differential it becomes difficult for the operator to determine whether the key has been activated. In the extreme situation, when the difference between the outside atmospheric pressure and the pressure within the cavities is quite large, the membrane switch assembly may become distorted with structural damage possibly being caused by the increasing pressure on the laminate walls caused by the outward expansion.

A similar result occurs when the outside atmospheric pressure becomes greater than the atmospheric pressure within the cavities. This would occur, for example, when the mechanism incorporating the membrane switch assembly is operated at a lower altitude than where the laminate was constructed. The result would be that the force exerted upon the wall of the laminate by the outside atmospheric pressure would move the walls of the laminate inwardly. The usual effect of this pressure differential would not be as significant as when the atmospheric pressure is less than the internal pressure. However, in the extreme condition when the pressure differential between the outside atmospheric pressure and the internal pressure becomes great, a switch could be activated.

It is to be observed that even under normal operating conditions, the gas within the cavities resists compression of the walls of the laminate when a user tries to activate the keys. This results in a cushioning effect which is felt by the user of prior art membrane switch assemblies. While under certain circumstances a cushioning effect may be desirable, it may also reduce the user's ability to activate a key or detect whether a key has been actuated.

Several methods have been utilized to try to alleviate the above-discussed disadvantages of prior art membrane switch assemblies. One proposed prior method involves incorporating internal passages, within the laminate between the cavities. This allows displacement of the fluid medium, particularly air, between the internal cavities of the membrane switch assembly. When one key is activated the fluid within the spacer sheet defined cavity associated with that key which is displaced by the downward force of the membrane wall will flow through the passages into one or more other cavities. While this will help to minimize the cushioning effect caused by the resistance of the internal pressure to the downward compression of the membrane wall, it will not alleviate the problems associated with an internal-external pressure differential.

It has also been proposed to equalize the internal pressure with the external atmospheric pressure by providing a hole in the outer layers of the membrane switch assembly commonly referred to as a through-hole. This through-hole in the laminate of the switch assembly allows air to flow freely into and out of the assemblies cavities. While this technique would solve the problems associated with the pressure differential between the external and internal pressures, it creates some of its own disadvantages. The major of these disadvantes becomes apparent with the incorporation of the completed membrane switch assembly into a final product. The through-hole vents would typically be provided through the entire assembly. While the holes on the front surface of the assembly may be sealed off, for example by an indicia bearing sheet, the holes at the back surface must remain clear. This causes difficulties when installing the switch laminate in products such as calculators, microwave ovens, thermostatic controls, etc. The membrane switch assembly would, to keep the through-hole open, have to either be spatially separated from the surrounding housing or the surrounding housing would have to be provided with corresponding holes to allow for a free flow of air into and out of the through-holes. This requires additional manufacturing steps or a larger housing to provide the spatial separation. Furthermore, since many membrane switch assemblies are secured within the final product through use of adhesives, during manufacturing special care would be required to avoid having the adhesive flow into or seal off the through-hole vents.

SUMMARY OF THE PRESENT INVENTION

The present invention overcomes the above-discussed disadvantages and other deficiencies of the prior art by providing a novel and improved membrane switch assembly.

In accordance with the present invention a membrane switch assembly is provided with edge venting passages. The switch assembly of this invention is comprised of an insulating spacer sheet which is sandwiched between two circuitry layers. These circuitry layers are each comprised of a non-conductive sheet having a conductor pattern disposed on at least a first surface thereof. These two circuitry sheets are positioned so that conductor patterns thereon face each other and are in vertical registration in the areas which are to define switches. The individual switches are defined by apertures provided within the spacer sheet which allows electrical contact between the two circuitry sheets. A decal sheet is usually bonded to the front surface of the assembly to designate the areas of the individual switches. A backing member is typically applied to the back surface to provide structural support for the assembly. The edge venting passages are, in a preferred embodiment, provided within the individual layers of the membrane switch assembly before the assembly is completed. This allows the assembly to be completed without the additional manufacturing step of providing holes through the switch assembly and also alleviates the problem of removing slugs of waste material from the assembly after providing the holes.

The edge venting passages of the present invention may be formed in several different ways. For example, in a first embodiment the spacer layer is provided with slits running from the apertures to its periphery. In this embodiment the edge venting passages are defined by the slits provided within the spacer sheet. In another embodiment of the present invention alternating slits or notches are provided within the circuitry layers and the spacer sheet so that a continuous passage runs from the periphery of the membrane switch assembly to the individual switch areas. It is also possible to reduce the number of edge venting passages by providing internal passages between individual switch areas. This allows two or more switch areas to be vented through only one edge venting passage. The notches or slits in the circuitry and spacer layers are provided in the initial manufacturing step of each layer.

The present invention has as one of its objects an improved membrane switch assembly which has passages for the venting of the switch areas without providing through-holes within the front or back surfaces of the assembly.

Another object of the present invention is to provide an improved membrane switch assembly which does not require the additional manufacturing step of providing passages through the completed switch assembly and thus avoids the problem of removing slugs from the assembly and the disposal of discrete waste.

BRIEF DESCRIPTION OF THE DRAWING

The present invention may be better understood and its numerous objects and advantages will become apparent to those skilled in the art by reference to the accompanying drawings wherein like reference numerals refer to like elements in the several figures and wherein.

DESCRIPTION OF THE PREFERRED EMBODIMENT

Figure 1A:
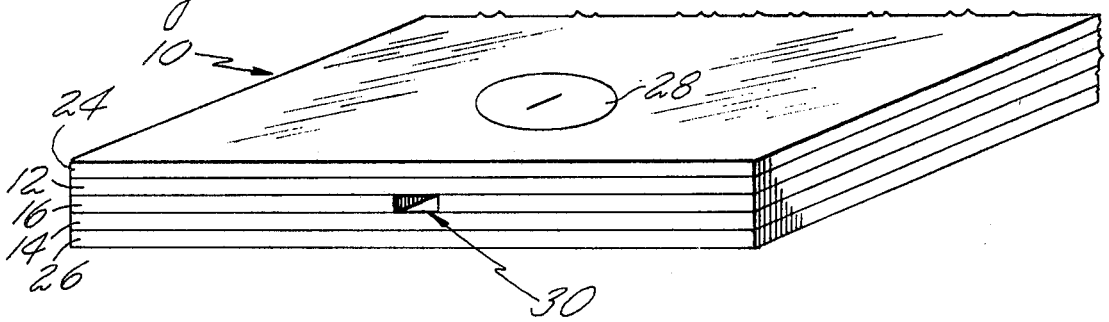
FIG. 1A is a perspective view of a completed membrane switch assembly according to one embodiment of the present invention.
Figure 1B:
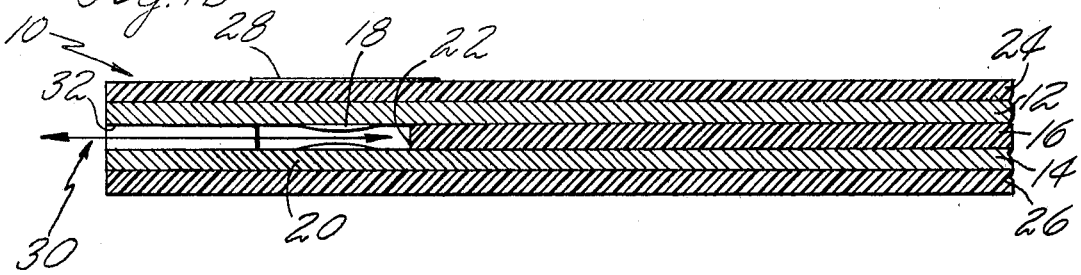
FIG. 1B is a sectional view of FIG. 1A taken along line 1—1.
Figure 1C:
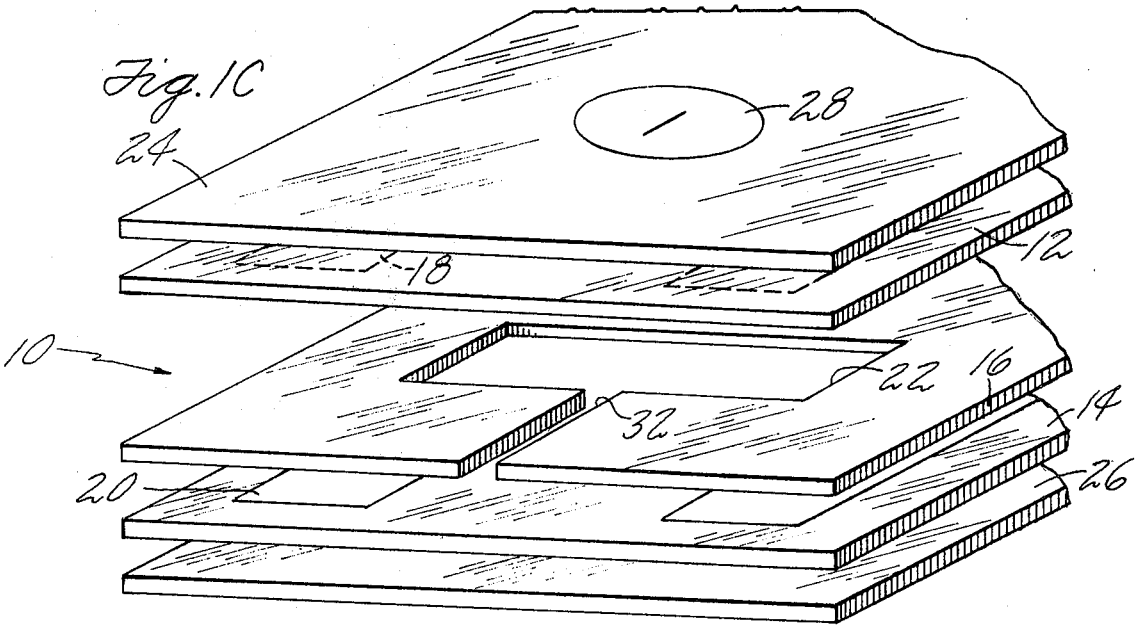
FIG. 1C is an exploded view of the switch assembly illustrated in FIG. 1A.

Referring to FIGS. 1A–1C, a portion of one embodiment of a membrane switch assembly according to the present invention is indicated generally at 10. Assembly 10 is of a multilayer construction. This multilayer construction is comprised of spacer sheet 16 sandwiched between top circuitry layer 12 and bottom circuitry layer 14. Circuitry layers 12 and 14 have circuit patterns 18 and 20 disposed on their facing surfaces by any known technique. Spacer layer 16 is provided with at least one aperture 22 by any known method. This allows a portion of the circuit pattern 18, upon circuitry layer 12, to be placed in electrical contact with a portion of the circuit pattern 20 of circuitry layer 14 by the compression of either circuitry layer 12 or 14 towards the other. The aperture 22, along with the registered portions of circuit patterns 18 and 20, thus define a switch. Assembly 10 may be completed by applying an overlay sheet 24 and a backing board 26, by any conventional technique.

Overlay sheet 24 is provided with at least one decal 28 which designates an individual switch area. Backing board 26 provides structural support for assembly 10.

The assembly 10 is provided with an edge vent 30. Edge vent 30 is defined by a slit or passage 32 provided within spacer layer 16. Passage 32 runs from the periphery of the switch assembly 10 to aperture 22. As seen best in FIG. 1B, air flows unobstructedly into and out of aperture 22 through passage 32. Preferably, passage 32 and aperture 22 are simultaneously provided within layer 16 during its fabrication to reduce the manufacturing steps.

Figure 2A:
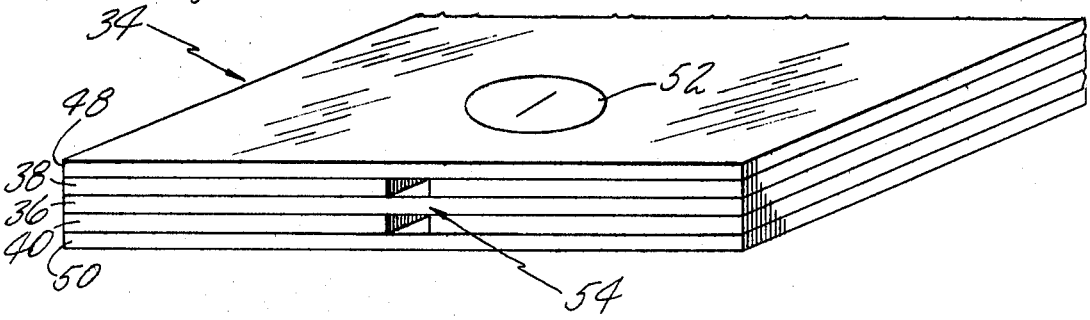
FIG. 2A is a perspective view of a completed membrane switch assembly according to another embodiment of the present invention.
Figure 2B:
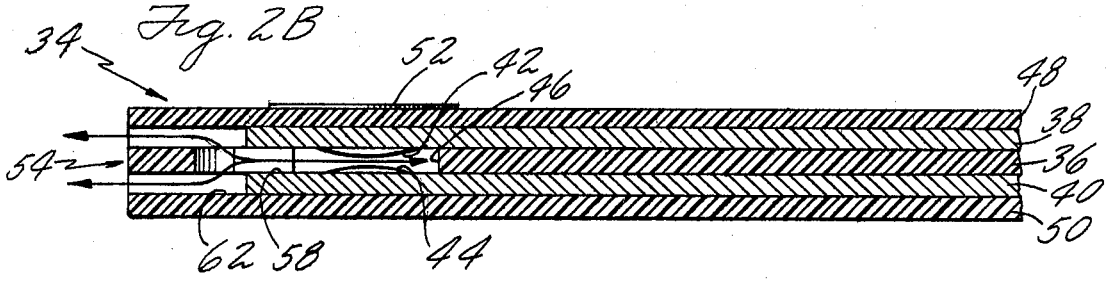
FIG. 2B is a section view of FIG. 2A taken along line 2—2.
Figure 2C:
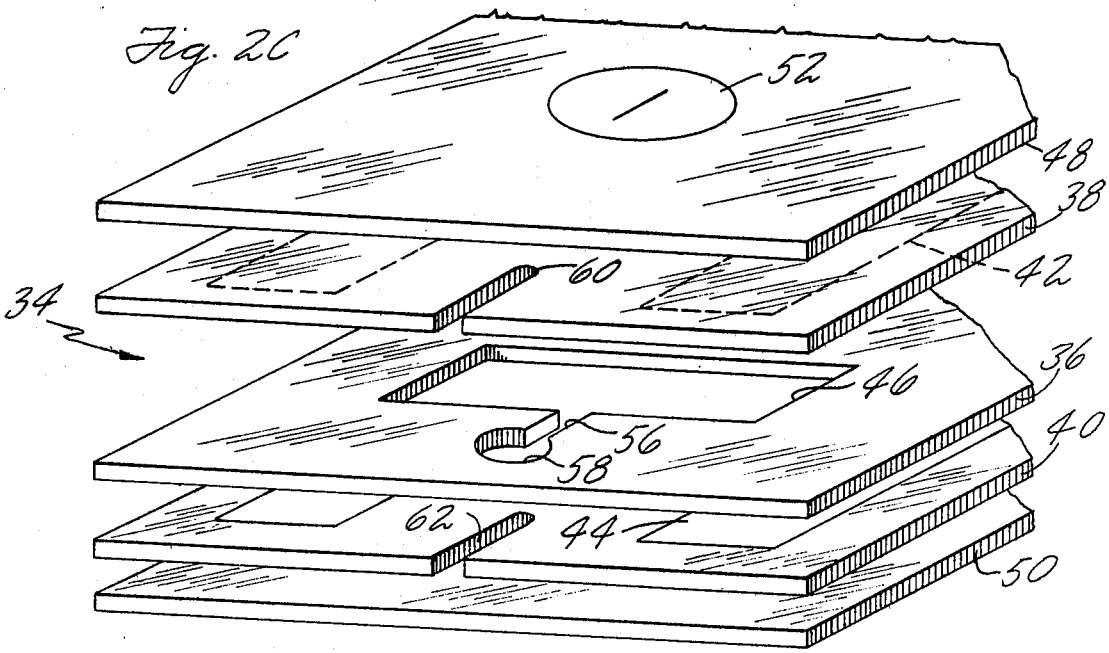
FIG. 2C is an exploded view of the switch assembly of FIG. 2A.

Referring now to FIGS. 2A–2C, another embodiment of a membrane switch assembly according to the present invention is indicated generally at 34. Assembly 34 is also comprised of a spacer layer 36 sandwiched between two circuitry layers 38 and 40. Circuitry layers 38 and 40 are provided with conductor patterns 42 and 44 respectively. Spacer layer 36 is provided with at least one aperture 46 which defines a switch area. The assembly 34 is completed by applying overlay sheet 48 and backing board 50. Overlay sheet 48 is also provided with at least one decal 52 which designates an underlying switch area.

Switch assembly 34 is provided with an edge vent 54 of split or two-passage construction. Edge vent 54 has the same function as edge vent 30 illustrated in FIGS. 1A–1C. Edge vent 54 is defined by cut-outs provided within circuitry layers 38 and 40 and spacer layer 36. Spacer layer 36 is provided with a passage 56 which extends outwardly a short distance from aperture 46. Passage 56 is preferably provided, at the end which is disposed opposite to aperture 46, with a circular aperture 58. Circuitry layers 38 and 40 are provided with passages 60 and 62 respectively. Passages 60 and 62 run from the periphery of assembly 34 to aperture 58. Circular aperture 58 has a diameter larger than the width of passage 56 and passages 60 and 62. This allows greater tolerance when aligning circular aperture 58 with passages 60 and 62. As best seen in FIG. 2B, air flows into and out of the switch area through either or both of passages 60 and 62, through circular aperture 58 and passage 56.

Figure 3A:
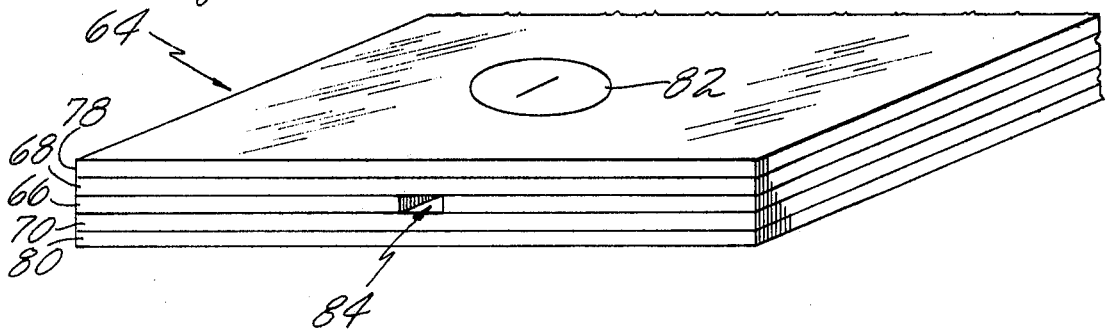
FIG. 3A is a perspective view of a completed membrane switch assembly according to a third embodiment of the present invention.
Figure 3B:
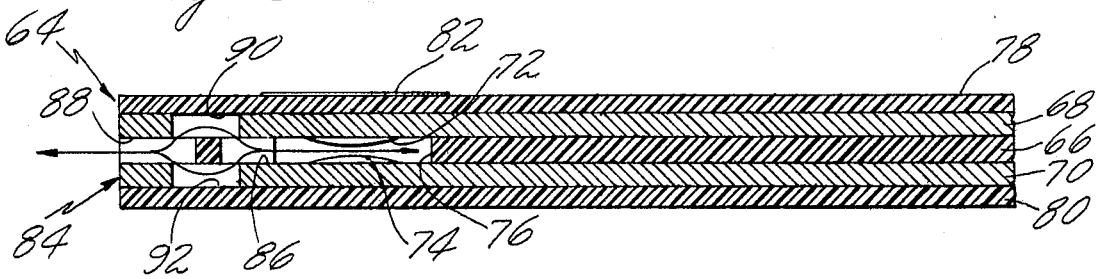
FIG. 3B is a sectional view of FIG. 3A taken along line 3—3.
Figure 3C:
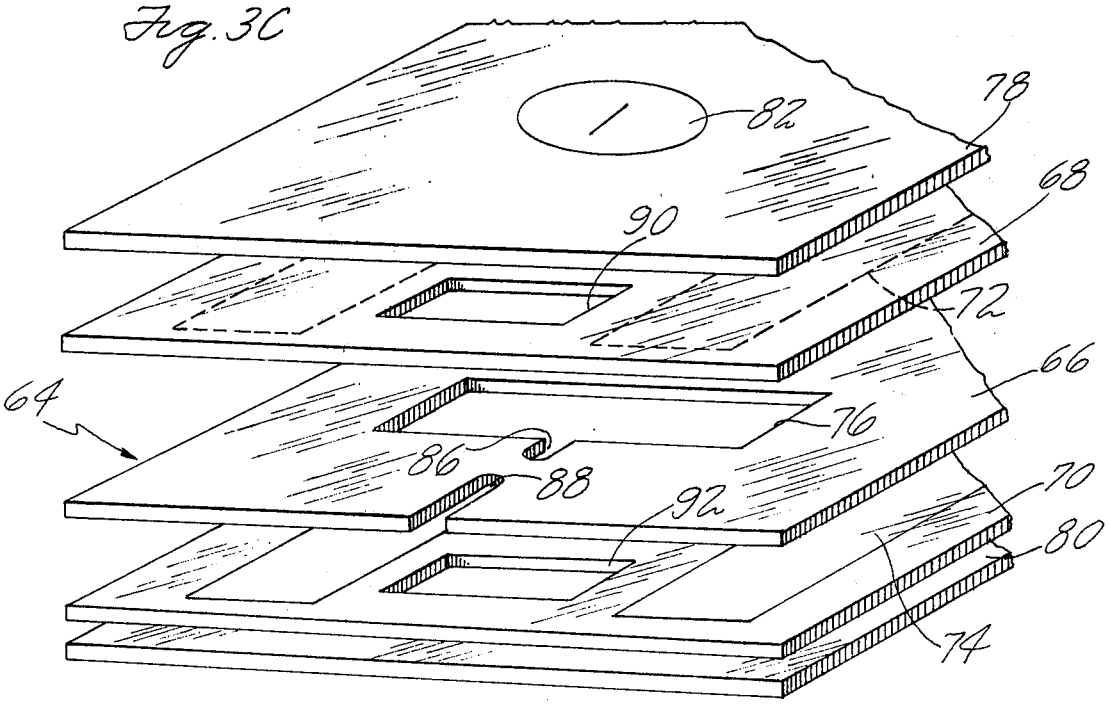
FIG. 3C is an exploded view of the switch assembly of FIG. 3A.

With reference now to FIGS. 3A-3C, another embodiment of a switch assembly in accordance with the present invention is indicated generally at 64. Assembly 64 has a similar construction to assembly 10 and assembly 34. A spacer layer 66 is sandwiched between two circuitry layers 68 and 70 which are provided with conductor patterns 72 and 74 respectively. Spacer layer 66 is provided with at least one aperture 76 which, along with the appropriate sections of conductor patterns 72 and 74 define a switch. Assembly 64 is completed by laminating overlay sheet 78 and backing board 80 to the switch sub-assembly. Overlay sheet 78 is provided with at least one decal 82 which identifies a switch by function and/or location. Switch assembly 64 is provided with edge vent 84 for allowing the flow of air into and out of the switch area.

Edge vent 84 is defined by various notches and apertures provided within circuitry layers 68 and 70 and within spacer layer 66. Spacer layer 66 is provided with a passage 86 and an edge notch 88. Passage 86 extends outwardly from aperture 76 which notch 88 extends inwardly from the periphery of assembly 64. Passage 86 and notch 88 are aligned with each other but are not connected. Circuitry layers 68 and 70 are provided with respective aligned apertures 90 and 92. Apertures 90 and 92 are of sufficient size and shape so as to provide a continuous passageway from aperture 76 through passage 86 and notch 88 to the surrounding environment. This is best illustrated in FIG. 3B.

It should be apparent to those skilled in the art that the connecting apertures 90 and 92 may have any desired shape so long as the desired continuous passageway is provided. The connecting apertures 90 and 92 should be shaped so as to allow for easy alignment with passage 86 and notch 88. It should further be apparent to those skilled in the art that edge vent 84 need only be provided with one connecting circuit layer aperture. This also applies to edge vent 54 of FIG. 2 which need only be provided with one passage in either of circuitry layers 38 or 40.

Figure 4:
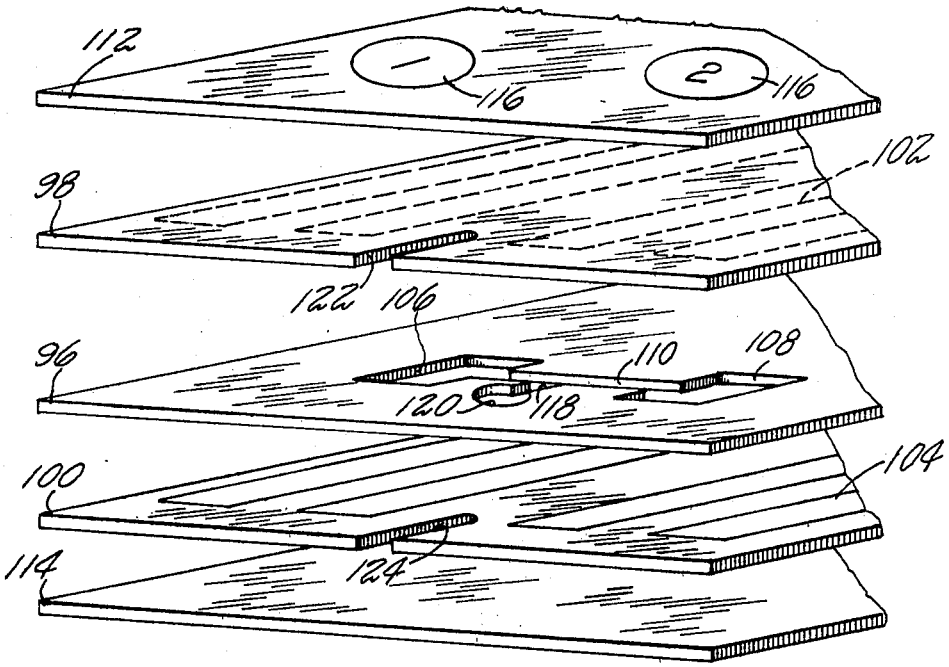
FIG. 4 is an exploded view of a fourth embodiment of a membrane switch assembly according to the present invention.

Referring now to FIG. 4, a fourth embodiment of a switch assembly in accordance with the present invention is indicated generally at 94. Switch assembly 94 is comprised of a spacer layer 96 sandwiched between two circuitry layers 98 and 100. Circuitry layers 98 and 100 have respective conductor patterns 102 and 104 disposed thereon. Spacer layer 96 is provided with at least two apertures 106 and 108. Apertures 106 and 108, along with the appropriate portions of conductor patterns 102 and 104, define switch areas. Apertures 106 and 108 are connected by internal passage 110 in spacer 96. Internal passage 110 allows air to flow between apertures 106 and 108. Assembly 94 is completed by laminating an overlay sheet 112 to circuitry sheet 98 and laminating a backing board 114 to circuitry sheet 100. Overlay sheet 112 is provided with at least two decals 116 which define the appropriate switch areas.

Switch assembly 94 is futher provided with an edge vent of similar construction to that illustrated in FIGS. 2A-2C. In the FIG. 4 embodiment, however, the edge vent extends from the internal passage 110 instead of the individual switch areas. The edge vent is comprised of passage 118 which runs from interconnecting passage 10 to a point disposed inwardly with respect to the periphery of assembly 94. Passage 118 terminates in a circular aperture 120 which registers with notches 122 and 124 provided in the edges of circuitry sheets 98 and 100 respectively.

The edge vents of the present invention may be provided in any manner within the membrane switch assembly so long as each individual switch area is vented to the surrounding environment. Furthermore, the edge vents illustrated in FIGS. 1A-1C and FIGS. 3A-3C may be substituted for the edge vent illustrated in FIG. 4.

In manufacturing the improved membrane switch assembly of the present invention the appropriate apertures, notches and passages are provided in the individual layers before the final construction. The apertures and notches in the spacer layer may be formed simultaneous with the apertures which define the switch areas. These apertures and notches may be provided within the spacer layer by any known technique such as die cutting. The circuitry layers may be provided with the appropriate notches, passages and apertures by any known means. Preferably, the circuitry sheets are also provided with apertures and notches by a die cutting method. Also it is preferred that the apertures and notches be formed during the manufacturing process when the webbing is removed from the cast circuitry layer substrate. This reduces the number of manufacturing steps since the appropriate apertures and notches are provided at the initial stage of manufacturing of the switch assembly.

While preferred embodiments have been described and illustrated, various modifications and substitutions may be made thereto without departing from the spirit and scope of the invention. Accordingly, it is to be understood that the present invention has been described by way of illustration and not limitation.

What is claimed is:

1. An electrical switch assembly comprising:

first circuitry layer means, said first circuitry layer means including a flexible non-conductive substrate having first and second oppositely disposed surfaces, said first circuitry layer means having an electrically conductive pattern disposed upon its second surface;

second circuitry layer means, said second circuitry layer means including a non-conductive substrate having first and second oppositely disposed surfaces, said second circuitry layer means having an electrically conductive pattern disposed upon its first surface, said first surface of said second circuitry layer means being positioned to face said second surface of said first circuitry layer means;

spacer means, said spacer means being a layer of electrical insulating material positioned between said first and said second circuitry layer means, said spacer means cooperating with said first and said second circuitry layer means to define at least a first peripheral edge of the switch assembly, said spacer means being provided with at least one aperture which forms a cavity between said first and second circuitry layer means whereby said conductive patterns on said circuitry layer means may be moved into electrical contact with one another; and vent passage means for venting said cavity, said vent passage means extending from said switch assembly first peripheral edge to said cavity whereby gas may flow freely between said edge and said cavity, said vent passage means comprising interconnected passage segments in said spacer means and in at least one of said first and second circuitry layer means.

2. The electrical switch assembly of claim 1 wherein said vent passage means comprises a cooperating arrangment of passage segments in said spacer means and said first and said second circuitry layer means, said cooperating passage segments defining a passage which is at least partly undulating between said spacer means and at least one of said first and second circuitry layers.

3. The electrical switch assembly of claim 2 wherein said cooperating passage segments comprise an opening in at least one of said first and said second circuitry layer means, said circuitry layer means opening communicating with and extending outwardly from said cavity generally toward and terminating short of said peripheral edge, said cooperating passage segments further comprising a passage segment in said spacer means, said spacer means passage segment at least partly overlapping said circuitry layer means opening and extending from said peripheral edge generally toward and terminating short of said cavity.

4. The electrical switch assembly of claim 3 wherein said spacer means opening is provided with an alignment aperture spaced from said passage segment in said spacer means and intersecting said cavity, said alignment aperture facilitating flow communication between said spacer means cavity and said circuitry layer means opening.

5. The electrical switch assembly of claim 2 wherein the arrangement of cooperating passage segments comprises a first passage segment in said spacer means, said first passage segment extending outwardly from said cavity and terminating short of said peripheral edge; and a circuitry layer passage segment in at least one of said first and second circuitry layer means, said circuitry layer passage segment extending inwardly from said peripheral edge and partly overlapping said first passage segment in said spacer means.

6. The electrical switch assembly of claim 5 including circuitry layer passage segments in each circuitry layer, each circuitry layer passage means extending inwardly from said peripheral edge and overlapping said first passage segment in said spacer means.

7. The electrical switch assembly of claim 5 wherein said first passage segment in said spacer means is provided with an alignment aperture at its end nearest said peripheral edge, said alignment aperture facilitating flow communication between said first passage segment and said circuitry layer means passage segment.

8. The electrical switch assembly of claim 1 wherein said vent passage means comprises a first passage segment in said spacer means, said first passage segment being connected to said cavity and spaced from said peripheral edge, and a second passage segment in at least one of said circuitry layer means, said second passage segment being in flow communication with said first passage segment, said second passage segment extending from said peripheral edge generally toward said first passage segment.

9. The electrical switch assembly of claim 1 wherein said vent passage means comprises a said first passage segment in said spacer means, first passage segment extending from said peripheral edge generally toward said cavity and terminating short of said cavity, and a second passage segment in at least one of said circuitry layer means, said second passage segment being in flow communication with said cavity and said first passage segment, said second passage segment extending from said cavity generally toward and terminating short of said peripheral edge.

10. An electrical switch assembly comprising:

first circuitry means, said first circuitry means including a flexible non-conductive substrate having first and second oppositely disposed surfaces, said first circuitry means having an electrically conductive pattern disposed upon said second surface;

second circuitry means, said second circuitry means including a non-conductive substrate having first and second oppositely disposed surfaces, said second circuitry means having an electrically conductive pattern disposed upon said first surface, said first surface of said second circuitry means being positioned to face said second surface of said first circuitry means;

spacer means, said spacer means being a layer of electrical insulating material positioned between said first and said second circuitry means, said spacer means cooperating with said circuitry means to define at least one peripheral edge of said switch assembly, said spacer means being provided with at least two apertures which define cavities between said first and second circuitry means whereby portions of the conductive patterns disposed on said circuitry means may be urged into electrical contact, said spacer means being provided with a passage which extends between said apertures whereby gas may flow freely between said apertures; and vent means for venting said cavities, said vent means comprising first passage means in said spacer means connecting said cavities, and second passage means in at least one of said circuitry means extending from said peripheral edge to said first passage means whereby gas may freely flow between either of said cavities and said peripheral edge.

* * * * *

UNITED STATES PATENT OFFICE

CERTIFICATE OF CORRECTION

PATENT NO. : 4,415,780

DATED : Nov. 15, 1983

INVENTOR(S) : James B. Daugherty et al

It is certified that error appears in the above-identified patent and that said Letters Patent are hereby corrected as shown below:

Column 1, line 29 "apetures" should be --apertures--

Column 5, line 66 "10" should be --110--.

Signed and Sealed this

*Sixteenth* Day of *April 1985*

[SEAL]

*Attest:*

DONALD J. QUIGG

*Attesting Officer* *Acting Commissioner of Patents and Trademarks*